United States Patent [19]

Rodda et al.

[11] Patent Number: 4,776,292

[45] Date of Patent: Oct. 11, 1988

[54] DEMAND RESPONSIVE SEWING MACHINE TAKE-UP AND THREADING ARRANGEMENT THEREFOR

[75] Inventors: Donald Rodda, Butler; Robert H. Larsen, Keyport, both of N.J.

[73] Assignee: SSMC Inc., Shelton, Conn.

[21] Appl. No.: 130,033

[22] Filed: Dec. 7, 1987

[51] Int. Cl.[4] ..... D05B 49/00; D05B 47/00

[52] U.S. Cl. ..... 112/241; 112/254; 112/302

[58] Field of Search ..... 112/254, 241, 302

[56] References Cited

U.S. PATENT DOCUMENTS

| | | | |
|---|---|---|---|
| 4,161,152 | 7/1979 | Herron | 112/254 |
| 4,183,313 | 1/1980 | Odermann et al. | 112/302 |
| 4,296,701 | 10/1981 | Larsen | 112/302 X |
| 4,453,480 | 6/1984 | Larsen et al. | 112/254 |
| 4,466,371 | 8/1984 | Larsen | 112/254 X |

*Primary Examiner*—H. Hampton Hunter

*Attorney, Agent, or Firm*—Robert E. Smith

[57] ABSTRACT

A demand responsive sewing machine thread take-up construction is disclosed accommodating a shortened thread introduction path which facilitates operator interface and reduces construction costs while providing for improved reliability and uniformity of thread manipulation by the take-up.

4 Claims, 3 Drawing Sheets

DEMAND RESPONSIVE SEWING MACHINE TAKE-UP AND THREADING ARRANGEMENT THEREFOR

BACKGROUND OF THE INVENTION

1. Field of the Invention

This invention relates to a sewing machine needle thread take-up mechanism of the demand responsive type, that is, in which the thread, after being drawn up by a driven thread engaging member to set each stitch, is lightly retained by the takeup mechanism for release only in response to subsequent demands from the stitch forming mechanism. More particularly, this invention relates to the combination of a take-up mechanism of the above character and a novel and advantageous arrangement for introducing thread thereto with which it is capable of cooperating.

2. Description of the Prior Art

U.S. Pat. No. 4,466,371 of R. H. Larsen for "Threading Arrangement for a Sewing Machine" issued Aug. 21, 1984 discloses a demand responsive take-up having a threading arrangement which requires parts to be manufactured with exceedingly close tolerances, thus increasing the cost of manufacture and requiring an elongated threading path which increases the difficulty of operator interface therewith.

SUMMARY OF THE INVENTION

It is an object of this invention to provide an improved demand responsive take-up construction with novel thread deflecting and retaining means adapting the take-pp for cooperation with an arrangement for introducing thread thereto which advantageously provides a simpler, substantially shortened threading path.

DESCRIPTION OF THE DRAWINGS

With the above and additional objects and advantages in view, as will hereinafter appear, a preferred embodiment of this invention will now be described with reference to the accompanying drawings in which.

DESCRIPTION OF THE PREFERRED EMBODIMENT

Figure 1:
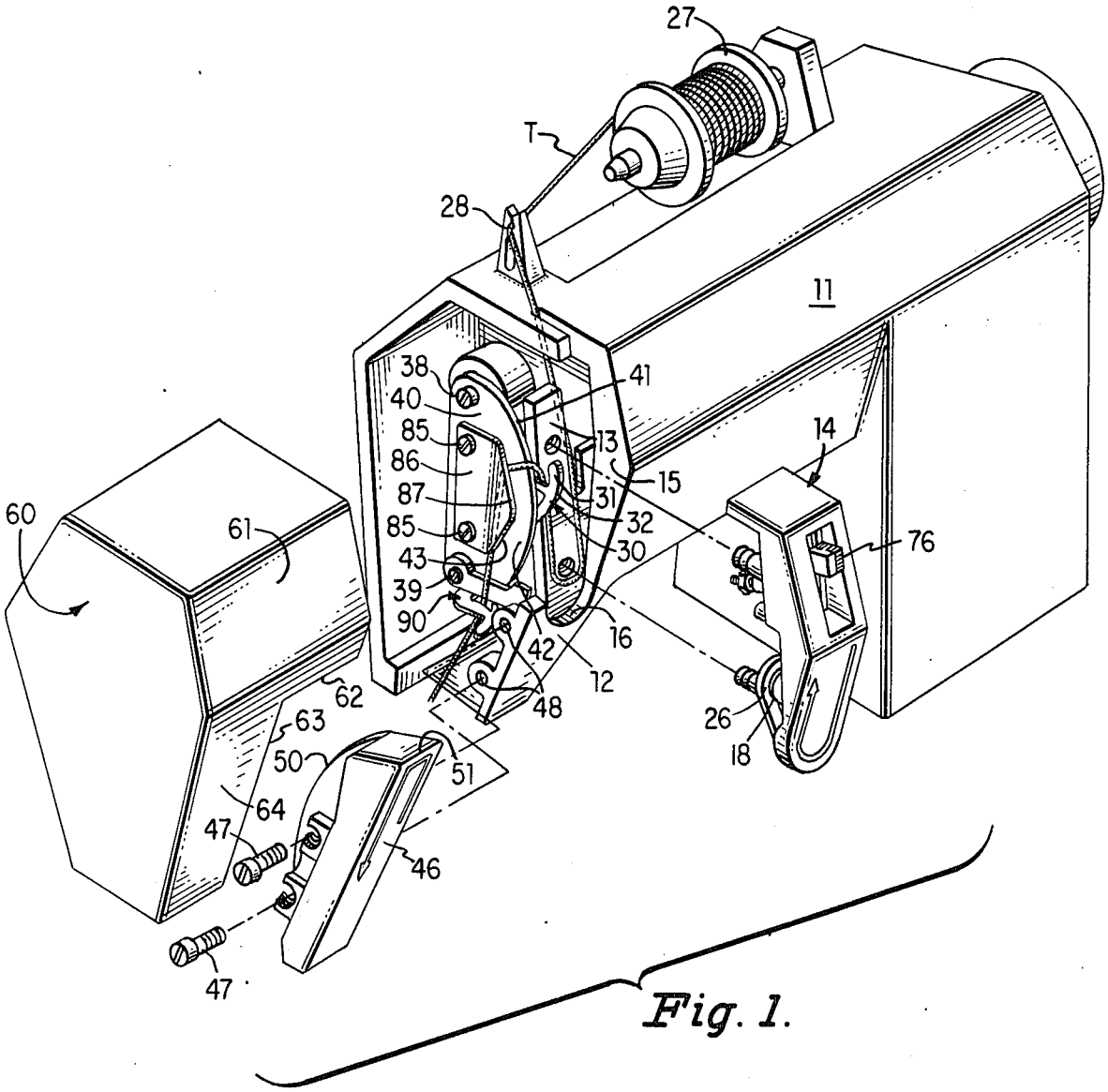
FIG. 1 is an exploded perspective view of a sewing machine bracket arm along with a thread tensioning module, and cover plate, and take-up threading cover in accordance with this invention.

Referring to FIG. 1 of the drawings, the reference character 11 designates the bracket arm of a sewing machine terminating in a sewing head portion 12 adapted to accommodate an endwise reciprocable thread carrying needle and means including thread tensioning and take-up mechanisms for manipulating and controlling the needle thread in the formation of lock stitches. The reciprocable needle, its support and drive, as well as the drive mechanism for oscillating the take-up arm may be of any well known, conventional form and are not illustrated in FIG. 1 so as not to obscure the thread manipulating and controlling features which form the subject matter of this invention.

Figure 2:
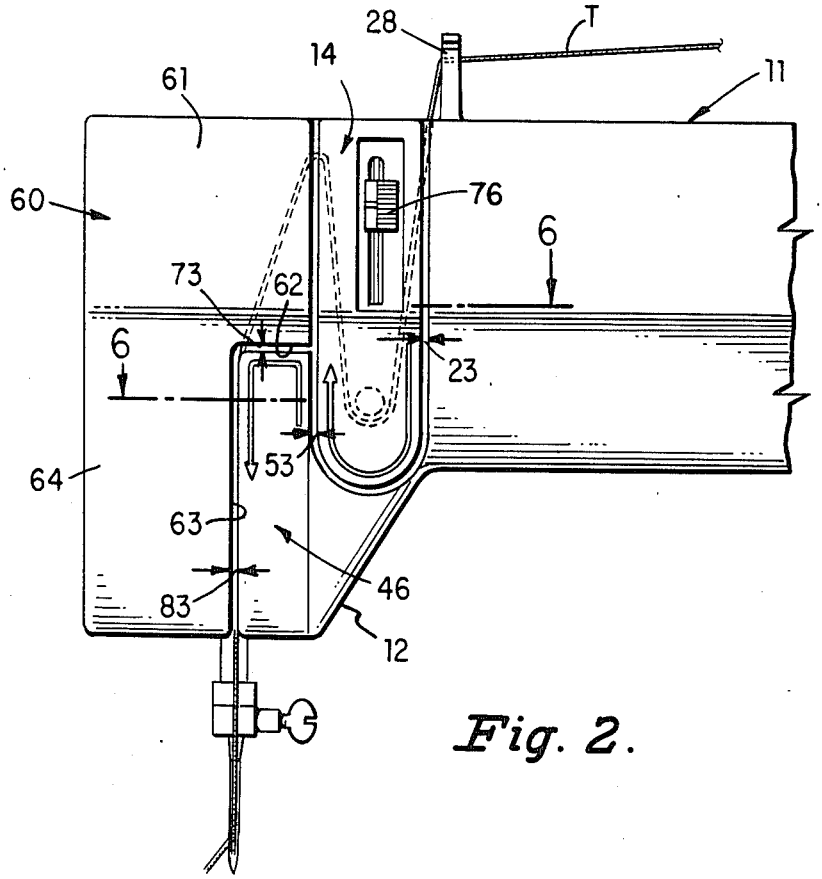
FIG. 2 is a front elevational view of a portion of the sewing machine bracket arm of FIG. 1 showing the parts assembled thereon.

As shown in FIG. 1, the sewing head portion 12 of the bracket arm 11 is open toward the front and toward the free extremity of the bracket arm, the opening being bordered, in part, by a recessed support 13 for a thread tensioning module 14. The thread tensioning module is of the type disclosed in U.S. Pat. No. 4,453,480, June 12, 1984, of R. H. Larsen et al which is incorporated herein by reference. The thread tensioning module 14 includes thread engageable parts 18 and 26 for applying tension to a thread introduced therebetween according to the position of a control knob 76. The support 13 is formed with a sidewall 15 and a bottom wall 16 shaped to accommodate the thread tension module 14 with side and bottom clearance therebetween sufficient to define a thread slot 23 as best shown in FIG. 2 into which a thread T from a spool 27 and a thread guide 28 on the bracket arm 11 may be introduced by a sewing machine operator as indicated by the arrow on the module 14 to direct the thread into position between the thread tensioning elements 18 and 26 on the thread tensioning module.

Referring again to FIG. 1, a take-up arm 30 is illustrated arranged for oscillation in a substantially vertical path adjacent to the tension module support 13. The free extremity of the take-up arm 30 is formed with an upturned finger 31 adapted on each upstroke of the take-up arm to engage and carry upwardly a loop of the thread T. The underside of the take-up arm extremity is formed with a curved shape 32 to deflect and disengage from the take-up arm any thread which might be encountered by the take-up arm on the downstroke.

Secured to the bracket arm as at 38 and 39 above and below the path of oscillation of the take-up arm 30 is planar polished metal wear plate 40 arranged substantially parallel to the path of motion of the take-up arm. An upper front edge 41 of the wear plate is shaped to match the path of the take-up arm free extremity during the take-up arm upstroke. A projection 42 from the lower extremity of the wear plate 40 extends upwardly and forwardly therefrom to define a thread confining passageway 43 along the lower extremity of the wear plate front edge 41.

Figure 6:
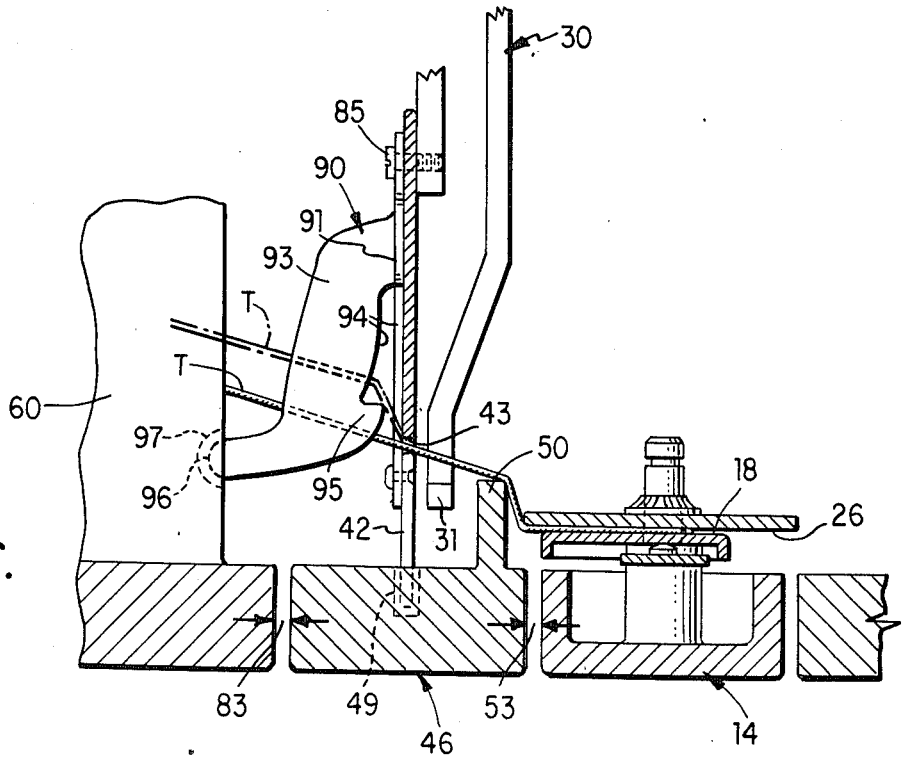
FIG. 6 is a cross sectional view taken substantially along line 6—6 of FIG. 2 illustrating in solid lines the thread as initially introduced to the take-up and as shown in FIG. 3, and showing in dot and dashed lines the thread as it is disposed during stitch formation in the position of the take-up arm movement shown in FIG. 5.

A take-up cover 46 is secured by fastenings 47-47 to bosses 48-48 formed on the bracket arm 11 so as to position the take-up cover in front of only the lower portion of the wear plate 40 and in spaced relation to the tension module to define a thread slot 53 therebetween joining the thread slot 43 as a continuation thereof. As best illustrated in FIG. 6, the take-up cover is formed with a recess 49 into which the free extremity of the wear plate projection 42 extends. The take-up cover is also formed with thread camming blade 50 which extends on the opposite side of the take-up-arm 30 from the wear plate and between the path of oscillation of the take-up arm and the thread tensioning elements 18 and 26 of the thread tensioning module 14. The take-up cover 46 terminates in an upper surface 51 located immediately above the recess 49 for the wear plate projection 42.

A head end cover 60 for the sewing head 12 includes an upper front portion 61 which, as shown in FIG. 2, is adapted to abut the thread tension module 14 when the head end cover is secured in place on the bracket arm. Both the under surface 62 of the upper front portion 61 of the head end cover and the right hand edge 63 of the lower front portion 64 of the head end cover, however, are shaped so as to accommodate the take-up cover 46 with clearance therebetween so as to define a thread slot 73 across the top of the take-up cover and a downwardly extending thread slot 83 along the side of the take-up cover opposite the tension module 14. An arrow placed on the take-up cover 46 indicates the threading path along the continuous slots 53, 73 and 83. From slot 83 the thread is directed through the eye of the needle and drawn taut ready for initiation of sewing.

Figure 3:
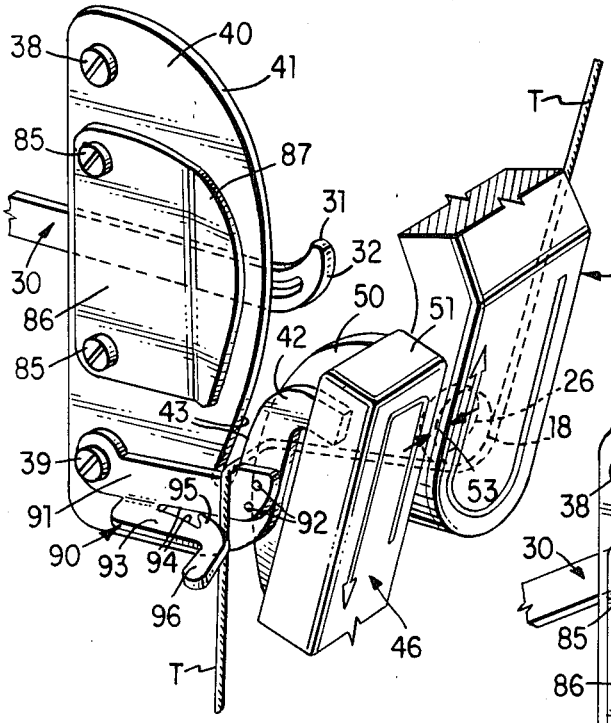
FIG. 3 is an enlarged perspective view of the take-up mechanism of this invention showing the thread as initially introduced thereto.

When thread T is introduced successively into the thread accommodating slots 23,53, 73 and 83 and prior to any operation of the sewing machine drive, the thread T will be positioned relative to the thread manipulating and controlling instrumentalities as illustrated in FIG. 3 and as shown in solid lines in FIG. 6. The thread will be directed between the thread engaging elements 18 and 26 of the tension module 14, around the thread camming blade 50 of the take-up cover and through the thread confining passageway 43 on the wear plate. If the take-up arm 30 is positioned above the thread T when the thread is introduced, the curved undersurface 32 of the take-up arm will deflect the thread temporarily out of the path of downward movement of the take-up arm and on the succeeding upward stroke, the finger 31 upturned on the take-up arm extremity will engage the thread T and begin drawing upwardly a bight of thread with a limb on each side of the wear plate 40.

Figure 4:
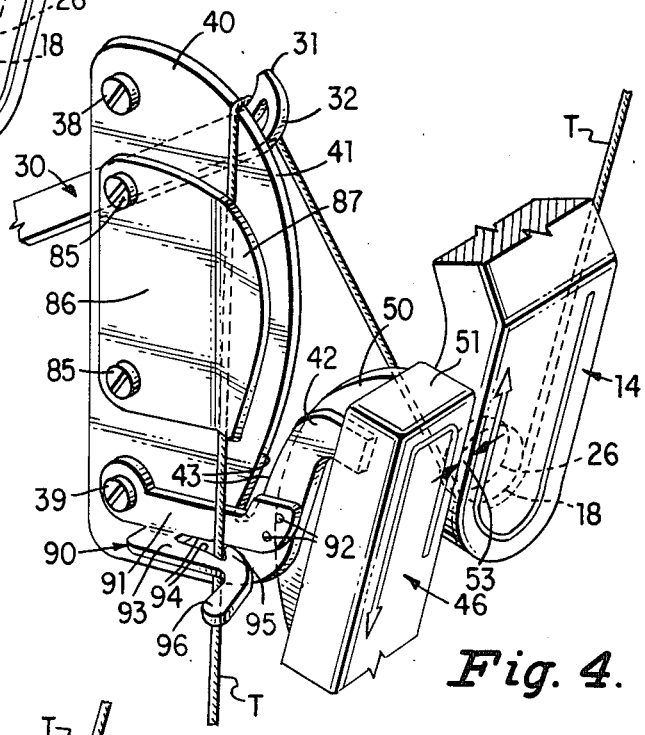
FIG. 4 is a perspective view similar to that of FIG. 3 but showing the thread take-up arm and the needle thread at the stitch setting extremity of take-up arm movement.

Attached to the left hand side of the wear plate as by rivets 85 is a flexible polished metal pinch plate 86 preferrably formed with an outwardly flaired front edge portion 87 serving to direct each upwardly drawn thread limb between the pinch plate and the wear plate as shown in FIG. 4. The thread thus frictionally retained against the wear plate will not necessarily follow the subsequent downward movement of the take-up arm but will be detained substantially in the uppermost stitch setting position forced by the upward stroke of the take-up arm until a demand exerted on the thread by operation of the needle, loopttaker,work feed mechanism or the like, draws the thread downwardly and out from between the pinch plate and the wear plate.

Figure 5:
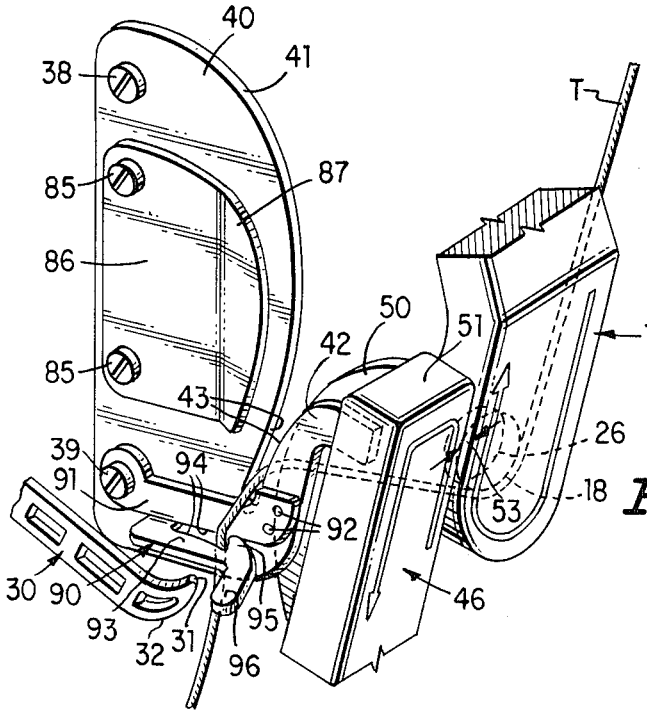
FIG. 5 is a perspective view similar to that of FIG. 3 but showing the thread take-up arm and needle thread after stitch setting and at the opposite extremity of thread take-up arm movement from that of FIG. 4.

As best shown in FIGS. 3, 4 and 5, a thread retaining element 90 is secured to the wear plate 40 beneath the pinch plate and adjacent the bottom of the thread confining passageway 43 in the wear plate. The retaining element 90 includes a body portion 91 which may be secured flush against the wear plate by the lower fastening 39 of the wear plate and by rivets 92 to the projection 42. Bent at right angles to the body portion is a thread constraining arm 93 defining with the body portion a thread accommodating slot 94. Preferrably the arm 93 is formed with an inturned thread detaining finger 95 tapered so as to readily admit thread into the slot 94 and to deter egress of the thread therefrom. The free extremity 96 of the arm 93 projects into a recess 97 formed in the head end cover 60 or in a member carried by the head end cover so as to prevent thread from inadvertently being passed over the arm 93.

On the first upstroke of the take-up arm after thread introduction to the system as shown in FIG. 4, the take-up arm in drawing the thread into position between the pinch plate and wear plate will also draw the thread past the thread detaining finger 95 and into the thread slot 94. On each succeeding downstroke of the take-up arm, as shown in FIG. 5, not only will the thread be constrained by the passageway 43 in the wear plate and the thread camming blade 50 on the take-up cover in the path of upward movement of the take-up arm for certain engagement thereby, but the thread retaining element 90 will prevent the thread which extends from the passageway 43 in the wear plate to the needle from uncontrolled excursion. Therefore, the influence and control exerted on the thread by the oscillation of the take-up arm will be uniform for each successive stitch.

Since the mechanism of this invention provides for operator introduction of thread to the system in any position of the take-up arm without requiring operator introduction of the thread to either the take-up arm or the thread frictioning means of the take-up, the thread path for thread introduction may be appreciably shortened, thus facilitating operator interface with this system. Shortening of the path for thread introduction is attained principally by an appreciable reduction of the height of the take-up cover 46 in comparison with prior known demand responsive take-ups. As a result the tolerance requirements on the construction and support of the take-up cover necessary to establish acceptable clearances for providing thread accommodating slots around the take-up cover are greatly reduced in in comparison with prior art arrangements resulting in an advantageous cost effectiveness.

Having set forth the nature and advantages of this invention, what is claimed therein is:

1. In a sewing machine having a bracket arm terminating in a sewing machine head, a thread take-up arm arranged transversely in said sewing head and oscillatable in a substantially vertical orbital path, said take-up arm formed at the free extremity with a thread engaging finger, and thread controlling means associated with said take-up arm including a wear plate arranged transversely in said sewing head adjacent said thread take-up arm, said wear plate being formed with a front edge arranged inwardly of and shaped to conform substantially with the orbital path of said thread engaging finger during upstroke of said take-up arm, and a flexible pinch plate secured against said wear plate for frictionally engaging a thread limb introduced therebetween by upstroke of said take-up arm, the improvement which comprises, means associated with said wear plate and defining with said front edge of said wear plate a thread constraining passageway terminating below said flexible pinch plate and above the lower extremity of said take-up arm orbital path, and means on said sewing machine bracket arm defining a thread accommodating slot for operator introduction of thread transversely of said take-up arm orbital path adjacent the lower extremity of said orbital path and into the thread constraining passageway defined along said wear plate front edge.

2. The combination set forth in claim 1 in which said means defining a thread constraining passageway with the wear plate front edge comprises a projection from said rear plate extending upwardly therefrom in front of said front edge to define said thread constraining passageway, and in which said means defining a thread accommodating slot includes a take-up cover carried by said sewing machine bracket arm and formed with a recess into which said free extremity of the wear plate projection extends to direct thread unerringly into said thread constraining passageway.

3. The combination set forth in claim 2 in which said means defining a thread accommodating slot also includes a thread tension module carried by said sewing machine bracket arm adjacent said take-up cover, said thread tension module including opposed thread engaging elements between which the thread is directed from a supply to apply tension to said thread, and in which said take-up cover is formed with a thread camming blade extending alongside the orbital path of said thread take-up arm for influencing a thread path from the thread engaging elements of said thread tension module to said thread constraining passageway on said wear plate in a position traversing the orbital path of said thread take-up arm during the upstroke thereof.

4. The combination set forth in claim 1 in which a thread retaining guide is supported on the same side of said wear plate as said pinch plate and beneath said pinch plate and said thread constraining passageway, said thread retaining guide being formed with a constricted entry way tapered to facilitate entry to said guide of that thread limb introduced between the pinch plate and wear plate by upstroke of said take-up arm, and being tapered to deter egress of thread from said retaining guide whereby said limb of thread introduced to said retaining guide when freed from between said pinch plate and wear plate by stitch forming instrumentality demand will be prevented from excessive excursion by said retaining guide.

* * * * *